United States Patent [19]

Aldrich et al.

[11] Patent Number: 4,544,025

[45] Date of Patent: Oct. 1, 1985

[54] HIGH GRADIENT DIRECTIONAL SOLIDIFICATION FURNACE

[75] Inventors: Billy R. Aldrich, Huntsville; William D. Whitt, Toney, both of Ala.

[73] Assignee: The United States of America as represented by the Administrator of the National Aeronautics and Space Administration, Washington, D.C.

[21] Appl. No.: 571,614

[22] Filed: Jan. 17, 1984

[51] Int. Cl.[4] ..... F27D 11/02

[52] U.S. Cl. ..... 165/65; 165/61; 165/30; 219/390; 219/395; 219/396; 432/18

[58] Field of Search ..... 165/61, 65, 30; 219/390, 395, 396

[56] References Cited

U.S. PATENT DOCUMENTS

| | | | |
|---|---|---|---|
| 3,644,097 | 2/1972 | Knudsen . | |
| 3,693,953 | 9/1972 | Michel . | |
| 3,732,063 | 5/1973 | Corsaro et al. . | |
| 3,770,047 | 11/1973 | Kirkpatrick et al. | 165/61 |
| 4,310,300 | 1/1982 | Mackenzie . | |
| 4,317,290 | 3/1983 | Voswinckel . | |

FOREIGN PATENT DOCUMENTS

| | | | |
|---|---|---|---|
| 119789 | 10/1978 | Japan | 219/390 |

*Primary Examiner*—Albert W. Davis, Jr.

*Attorney, Agent, or Firm*—Joseph H. Beumer; John R. Manning; Leon D. Wofford, Jr.

[57] ABSTRACT

A high gradient directional solidification furnace is disclosed which includes eight thermal zones throughout the length of the furnace. In the hot end of the furnace, furnace elements (25, 26, and 40) provide desired temperatures. These elements include Nichrome wire (28) received in a grooved tube (30) which is encapsulated by an outer alumina core (32). A booster heater (40) is provided in the hot end of the furnace which includes toroidal tungsten/rhenium wire (42) which has a capacity to put heat quickly into the furnace. An adiabatic zone is provided by insulation barrier (62) to separate the hot end of the furnace from a cold end. The cold end of the furnace is defined by heating elements (80 and 90). A heat transfer plate (70) provides a means by which heat may be extracted from the furnace and conducted away through liquid cooled jackets (72). By varying the input of heat via the booster heater (40) and output of heat via the heat transfer plate (70), a desired thermal gradient profile (120) may be provided.

20 Claims, 3 Drawing Figures

HIGH GRADIENT DIRECTIONAL SOLIDIFICATION FURNACE

ORIGIN OF THE INVENTION

The invention described herein was made by employees of the U.S. Government and may be manufactured and used by or for the Government for governmental purposes without the payment of any royalties thereon or therefor.

BACKGROUND OF THE INVENTION

The invention relates to a furnace which is suitable for use in processing samples of material specimens in space. Particularly, the invention is directed to a furnace having a high thermal gradient which is impressed upon the material as it is processed in the furnace.

Experiments in the past have been conducted using a standard Bridgman-Stockbarger type apparatus, which basically provides for passing the experiment material from a heated zone to a cold zone relying primarily on radiation heat transfer and gas conduction to transmit thermal energy into and out of the experiment sample. Whereas radiation heat transfer is adequate in the hot zone of such systems, it is very inefficient at the cold end of the thermal gradient. Poor heat transfer in the cold end coupled with the normal temperature "roll-off", or axial heat loss from an unguarded main heater limits the maximum thermal gradients achievable by this method.

Prior Bridgman-Stockbarger directional solidification systems designed for space flight have been limited to thermal gradients of approximately 250° C./cm with the hot temperatures at 1000° C. and a sample diameter of a few millimeters. With the present invention, thermal gradients of up to approximately 500° C./cm in samples of up to 12 millimeters can be achieved.

Accordingly, an important object of the present invention is to provide a directional solidification furnace which may be used in processing specimens of material in space and which has a high thermal gradient.

Another important object of the present invention is to provide a directional solidification furnace for use in space operations which has a gradient zone in which the thermal gradient impressed upon the specimen of material may be controlled.

Still another important object of the present invention is to provide a directional solidification furnace which is comprised of modular components which can be rearranged to tailor the furnace to carry out different experiments.

Still another important object of the present invention is to provide a directional solidification furnace in which the heating elements of the furnace are modular components and may be expeditiously replaced.

Still another important object of the present invention is to provide a directional solidification furnace which provides manipulation of the sample in space by way of processing the material and then stores the processed sample for return to ground.

SUMMARY OF THE INVENTION

The present invention relates to a material processing furnace having an elongated tube for receiving a material sample and a plurality of temperature-controlling elements placed in zones outside and along the length of the tube, and in heat-transfer relation therewith. The elements, which may be heating, cooling or passive in character, are selected and placed so as to provide a desired temperature profile along the length of the tube. For directional solidification applications one end portion of the tube is heated under conditions such as to provide an isothermal "hot" region, and a portion at the other end is heated to a lesser temperature to provide an isothermal "cold" region, the hot and cold regions being separated by an adiabatic region having a steep thermal gradient. These conditions are obtained by means of a selected series of heating elements and passive elements disposed in zones at the hot and cold regions and by use of a passive insulated element for the thermal gradient region, with a booster heater element being placed adjacent the insulation element on its hot side and a heat-transfer plate on its cold side. Required temperature profiles along the length of the tube are produced by controlling the electrical power to the various heating elements.

Normal operation of the furnace would consist of heating the sample material in the isothermal hot region to a temperature above its melting point and establishing the desired thermal gradient by adjusting the furnace cold end conditions. The experiment sample is then translated through the thermal gradient region. The position of the solid/liquid interface of the experiment sample is controlled by varying the heat flow into and out of the different control zones. This enables the experimenter to locate the interface in the center of the thermal gradient region where the goal is to obtain flat isotherms in the experiment material, or to position the inflection point of this sigmoidal curve in different locations of the furnace for experiments other than directional solidification, such as vapor transport or solution growth.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof wherein an example of the invention is shown and wherein.

DESCRIPTION OF A PREFERRED EMBODIMENT

Figure 1:
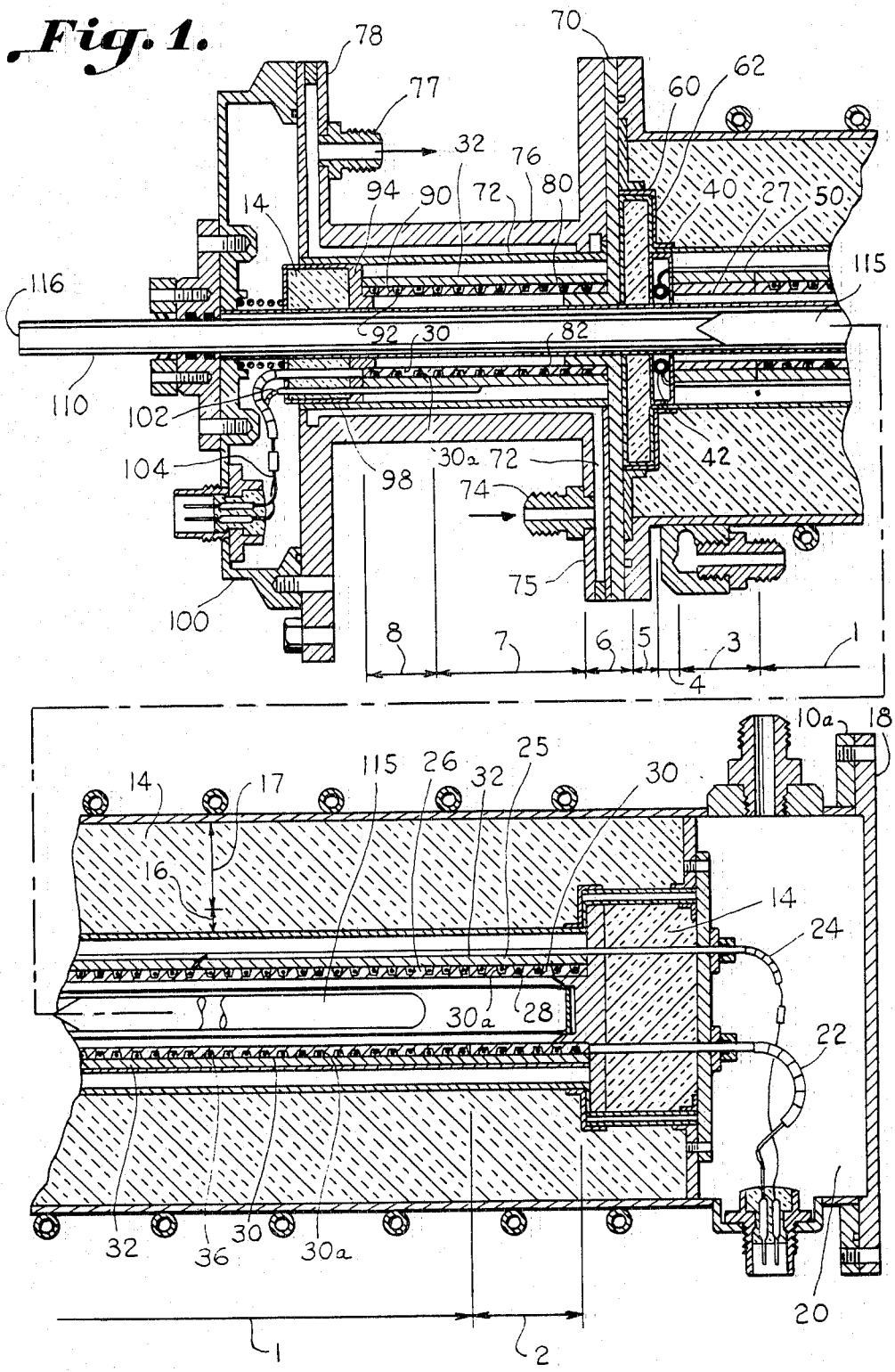
FIG. 1 is a sectional view illustrating a high gradient directional solidification furnace constructed according to the present invention.
Figure 2:
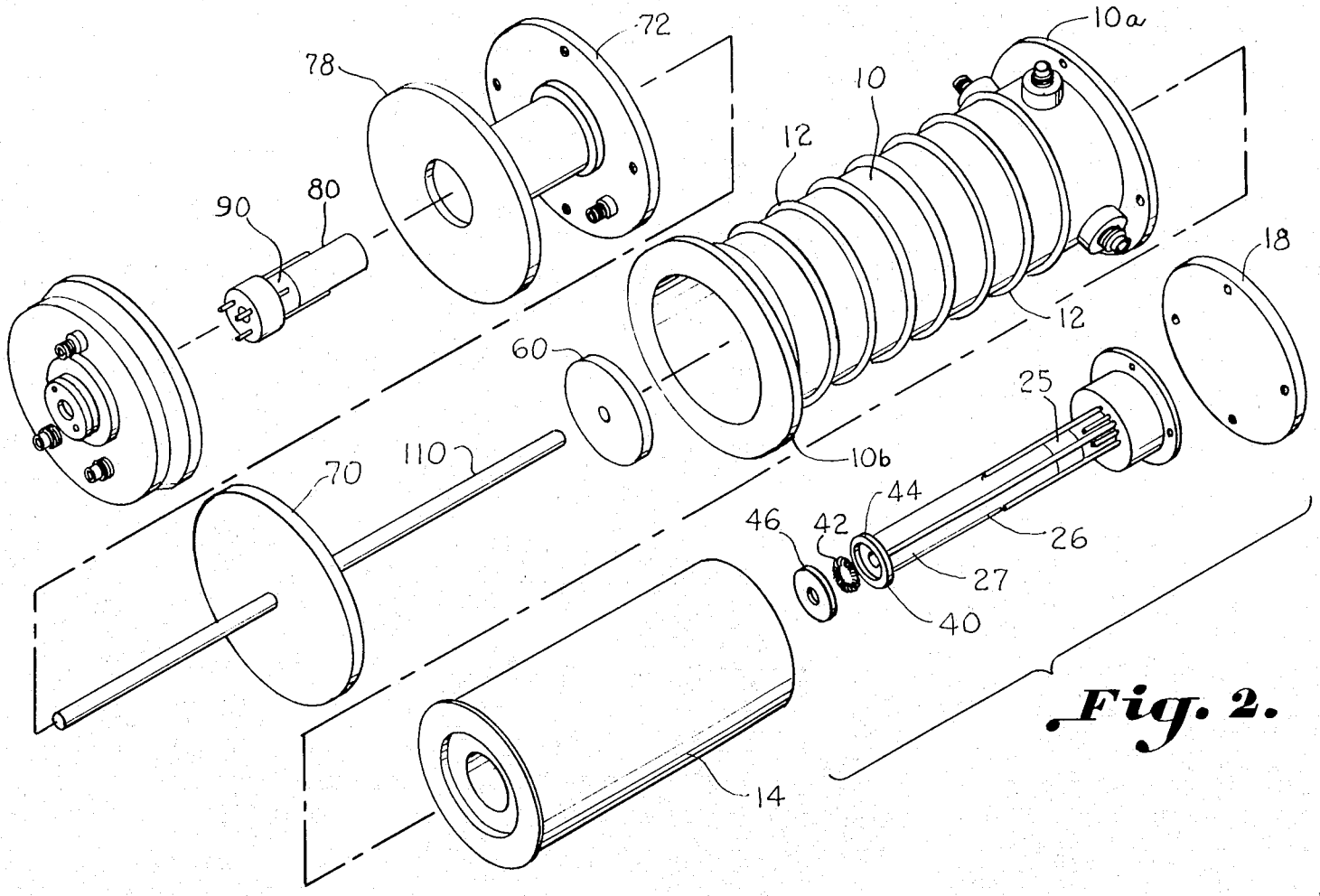
FIG. 2 is a perspective view with parts separated showing the modular construction for a high gradient directional solidification furnace constructed according to the present invention.

The furnace has eight thermal control zones. Each thermal control zone is either heated, cooled, or passive depending on the experiment requirement. This enables the furnace to establish a variety of thermal profiles. The furnace is primarily designed to produce steep thermal gradients, however, varying the different control zones enables it to operate with a variety of thermal gradients from isothermal (no gradient) to very steep gradients. The eight control zones will be briefly described in relation to their characteristics.

There is a hot zone 1 used to initially heat the sample up to the desired operating temperature and then to maintain the steady-state hot end temperatures. During steady-state operation ths zone requires a relatively small amount of power to make up for the furnace intrinsic heat losses. This zone is approximately 30.32 cm (8 inches) long, but when combined with a hot end guard heater zone 2 and a hot end passive zone 3 provides a hot processing region of 25.4 cm (10 inches).

Hot guard heater zone 2 is an independently controllable heating zone which allows the isothermal regions of the hot zone to be extended closer the end of the furnace. This zone is 2.54 cm (one inch) long and operates at a relatively high power input. It makes up for the heat loss out the end of the processing zone. This zone being controllable gives the capability of not only establishing a long isothermal region, but by raising it higher than the hot zone, can produce a continuous positive temperature gradient from the end of the furnace to the gradient zone. This condition is required in some materials processing experiments that cannot tolerate a temperature inversion in the hot section of the furnace such as mercury-cadmium-telluride.

The hot passive zone 3 is passive i.e, it has no active thermal element or control. It is located between the hot zone 1 and a booster heater zone 4. The zone is 2.54 cm (one inch) long and provides an area of no thermal input but rather is heated by the booster heater. The temperature dip that might occur as a result of this zone not being heated is taken care of by the heat leveling capability of the ceramic core tube and by the heat flux emanating from the booster heater as will be more fully described hereinafter. The hot passive zone 3 allows the hot zone temperature rollover to be moved closer to the gradient zone without raising the temperature at the gradient end of the hot zone higher than desired. A steeper thermal gradient is achieved by moving the hot zone temperature rollover toward the gradient zone.

The booster heater zone 4 in conjunction with the hot passive zone 3 raises the temperature as high as permissable immediately upstream of an adiabatic gradient zone 5, thereby providing steeper thermal gradients. The booster heater zone is located between the hot passive zone 3 and the adiabatic zone 5. This heater must be very narrow in order to direct the heat flux into a narrow region of the furnace. It must also be capable of inputting a large portion of the total energy required by the furnace. Because of this the booster heater must operate at temperatures well above the temperatures of the other heaters, requiring it to be constructed of heater alloy wire with higher temperature capability. The booster heater zone is 0.343 cm (0.135 inches) long.

Adiabatic zone 5 is passive and thermally insulated and is where the thermal gradient is established. It is located between the booster heater zone and a heat sink zone 6. The purpose of zone 5 is to prevent axial heat flow, which if allowed to occur, would degrade the thermal gradient. The experiment solid/liquid interface will be located in the adiabatic zone. The adiabatic zone provides an area in the sample where plain isotherms can be produced.

The heat sink zone 6 in conjunction with a cold heater zone 7 and by means of a liquid cooled heat sink controls the cold end of the thermal gradient. The heat sink zone 6 is located between the adiabatic zone 5 and the cold heater zone 7. Thermal energy is extracted from the sample and conducted to the liquid cooled heat sink via a heat transfer plate in the zone 6. By changing the heat transfer properties of this plate and by varying the volume flow rate of the liquid coolant, changes in heat transfer from the cold end of the sample can be obtained. The change in heat transfer properties of the heat transfer plate is obtained by varying the material and thickness of the plate. The modular design of this furnace makes it easy to remove or change out the heat transfer plate. The heat sink zone is 0.635 cm (0.25 inches) in length.

The cold end heater zone 7, in conjunction with the heat sink zone, provides the capability of varying the furnace cold end temperature. The desired thermal gradient cold end temperatures can be obtained by adjusting the cold end heater temperature and coolant flow rate. Additionally, the thermal gradient can be made more steep by adjusting the heat transfer plate to extract the maximum amount of heat so as not to cause a temperature dip upstream of the cold end heater zone. The cold end heater zone is 12.7 cm (5 inches) long.

There is a cold guard heater zone 8 which helps to reduce the amount of axial heat loss from the cold end heater zone 7. This makes the isothermal length of the cold end heater longer. The cold guard heater zone is 2.54 cm (1 inch) long.

Referring now in more detail to the drawings, a directional solidification furnace is disclosed having the above described zones which includes an outer housing 10. The housing 10 is water cooled by means of water cooling coils 12 which encircle the outside of the housing. The water cooling coils 12 are arranged in a spiral which encircles the housing. There is a core of insulation 14 inside the housing 10 which is comprised of alternate horizontal layers of 0.0005 inch thick molybdenum and quartz wool. This allows the furnace to be operated in a vacuum, or under inert or reducing gas atmospheres. Adjacent the hot zone 1 is a zone 16 of alternate layers of zirconia and 0.0005 inch thick molybdenum. The zirconia and molybdenum layers cover a zone of approximately ⅜ of an inch closest to the furnace interior diameter. The remainder of the insulation core 14 toward the outside is quartz wool and molybdenum in alternate layers.

There is an end plate 18 which closes the housing 10 on one end. Adjacent the end plate is a space 20 thermocouple wires and electrical leads which go to the heating elements. There are six electrical power leads 22 connected to three heating elements 25, 26, and 40 with two power leads being connected to each heating element. Six thermocouples 24 are provided, with two of the thermocouples 24 being associated with each of the three heating elements for control purposes. The heating elements 25, 26, and 40 are located in the hot guard zone, hot zone, and booster heater zone, respectively.

The heating element 25 is the hot guard heater in the hot guard zone 2 which consists of a Nichrome V nickel base alloy wire spiral wound about a grooved alumina core tube 30 with the wire being denoted as 28 in the grooves 30*a*. (Nichrome is a registered trademark of Driver-Harris Company). The outside of the core 30 is an alumina retainer 32 which may either be cast or may be attached in the form of an outer cylinder cemented to the core.

The main heating element 26 in the hot zone 1 similarly consists of grooved alumina core 30 having windings 36 of Nichrome V heater wire wound about the core 30 in the grooves 30*a*. A similar outer substrate 32 of alumina is formed about the inner core 30 for retaining the heater element wire. The main heating element 26 has a length of approximately eight inches long. The main differences between the hot guard heater 25 and the main heater 26 is the diameter of the Nichrome V heater wire 28, 36. In the hot guard heater section, the diameter of the wire is sized so that the resistance of the wire will generate enough heat at twenty-eight volts to provide the proper temperature. The same is true of heater element 26.

Referring now to the booster heater zone 4, there is a booster heater 40 which includes a ring 42 of tungsten-rhenium wire wound in spirals in an annular fashion. The tungsten-rhenium heater coil is enclosed between two layers of alumina 44 and 46 which are cemented together. The toroidal shape of the heating element 42 and the composition of the element which is seventy-four percent tungsten and twenty-six percent rhenium enable a large amount of heating to be accomplished in a narrow space.

In the passive heating zone 3 there is no heater element, which allows a gap to be provided between the main heating element and the booster heating element. The passive heating zone 3 allows heat from the booster heater to be dissipated to the right of the booster heating zone 4 so as not to cause a dip or a bump in the thermal profile of the sample being processed.

Referring now to the adiabatic zone 5 the adiabatic zone includes a housing 60 made of Inconel, which is a nickel-based alloy. (Inconel is a registered trademark of The International Nickel Company). Inside the Inconel housing are thirty-six alternating layers 62 of half-mil thickness molybdenum and quartz wool. The width of the insulation is approximately one centimeter. The adiabatic zone provides an insulation barrier between the hot and cold ends of the heater.

A heat transfer plate is illustrated at 70 in the heat sink zone 6 for conducting heat away from the experimental sample. The plate may vary in its composition and dimension so as to vary the conduction rate of heat. In practice, both brass and stainless steel plates have been utilized to conduct away the heat. A cooling jacket 72 is located adjacent the heat transfer plate 70 for carrying away the heat which is conducted by the plate. The cooling jacket includes an inlet plug 74 carried on one flange 75 of a heat sink assembly housing 76 and exits the jacket through an outlet plug 77 carried on an opposing flange 78 of the heat sink housing. The housing 76 is thus in the form of a spool.

Located along the main processing channel adjacent the adiabatic and heat sink zones is the cold end heater zone 7 which includes a heater 80 similar to the hot end heater 26. Heater 80 includes Nichrome V wire 82 wound in grooved tube 30 encapsulated by alumina core 32. The cold end heater, however, will be operated at less power so that the temperatures produced in this section of the furnace will be lower.

Next, in the cold guard heater zone 8 there is provided at 90 a heater which is essentially identical to the hot guard heater 25. Heater 90 includes a Nichrome V wire 92 contained in grooved tube 30. The cold guard heater covers about one inch of the length of the furnace. Adjacent the end of cold guard heater zone 8 is a base 94 forming part of a housing 98 which includes an insulation core 14 of alternating one-half mill thickness molybdenum and quartz wool layers.

In one example, the hot guard heat wire 28 was 22 guage Nichrome V wire. The hot wire 36 was 17 guage Nichrome V type wire. The cold heater element 80 contained 20 guage Nichrome V type wire and the cold guard heater 90 utilized 22 guage Nichrome V heater wire. The tungsten-rhenium wire in the booster heater 40 was 0.02 inches in diameter. The temperature in these zones may be achieved by varying the power to these wires.

An enclosure housing 100 is carried at the end of the furnace which encloses the flange plate 78 of the heat sink housing and provides a housing for thermalcouples 102 and power leads 104 going to the cold end and cold guard heater elements 80 and 90.

A muffle tube 110 extends centrally through the furnace. The muffle tube is made from 310 stainless steel. The walls of the steel muffle tube are ten thousandths of an inch in thickness, which thickness is suitable for providing the required heat transfer between the various zones of the furnace. The muffle tube 110 isolates the various zones of the furnace from one another, thus allowing different atmospheres to be run in different portions of the furnace. The specimen is contained in a quartz ampule or tube 115 which is inserted through an open end 116 of the muffle tube 110. Any suitable mechanism may be utilized for pulling the tube 115 through the furnace at a desired rate from right to left.

Figure 3:
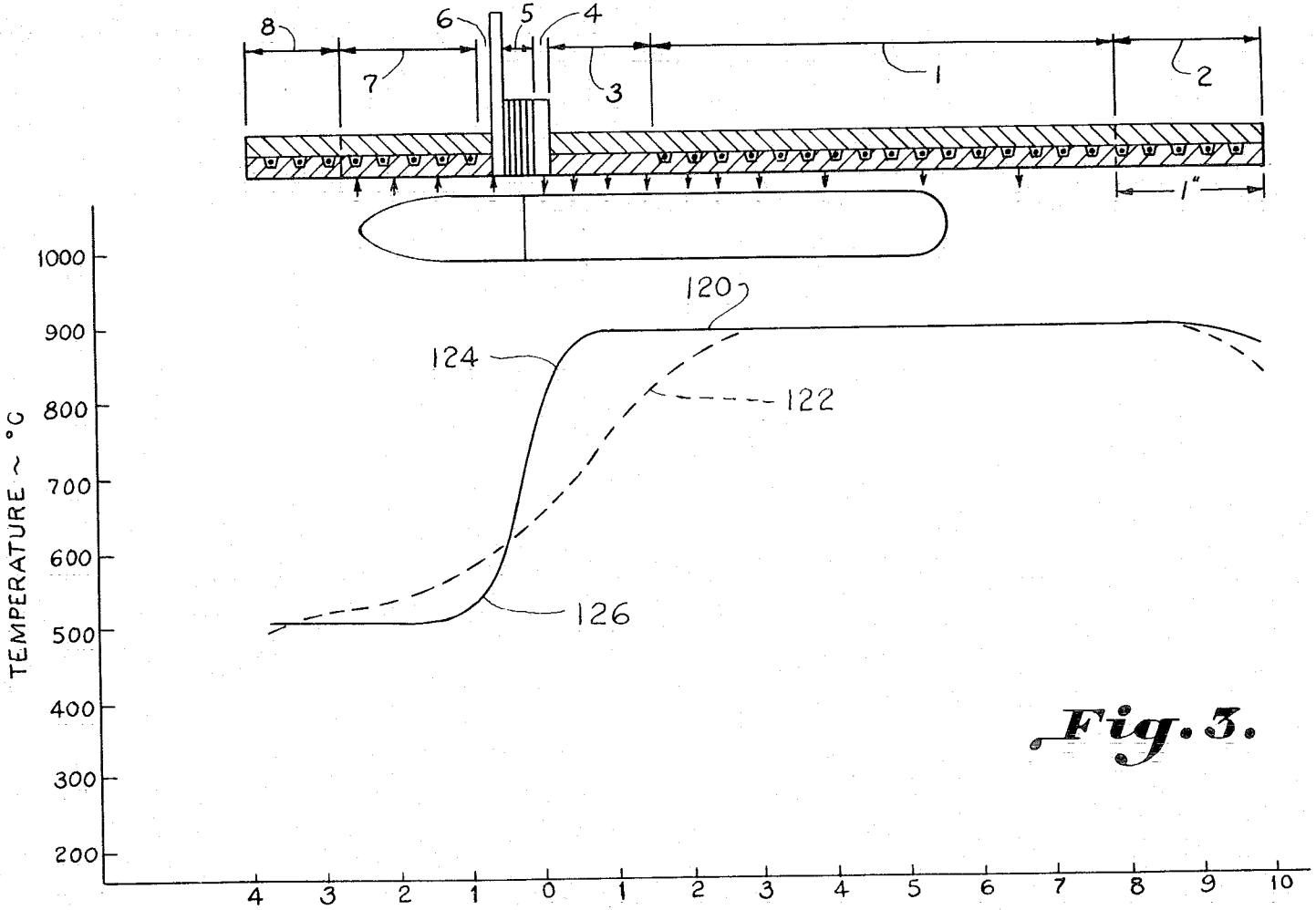
FIG. 3 is a plot of temperature versus furnace zone position for a material specimen illustrating the high thermal gradient achieved with a furnace constructed according to the present invention.

FIG. 3 illustrates the thermal profile and gradient achieved with the solidification furnace of the present invention. Temperature is plotted along the zones of the furnace in distance (centimeters) as shown by the solid line 120. The dotted line 122 shows the same profile for a conventional two-zone furnace. It can be seen that the thermal gradient is much more pronounced and steeper for the directional solidification furnace of the present invention. The knees 124 and 126 of the curve 120 may be shifted to shape the slope of the thermal gradient and provide a desired profile. For example, the knee 126 may be shifted to the right by taking more heat out of the furnace in the heat sink zone 6. The knee 124 may be shifted to the left by putting more heat into the furnace in the booster heater zone 4. The result is a steeper slope and thermal gradient.

This materials processing system is of modular design, allowing it to be assembled in different configurations. The end flanges of each major segment are identical; as a result the major segments such as the hot section, heat transfer plate, heat sink, and end caps can be interchanged. For instance, two hot-zone heaters can be joined together to provide one isothermal heater. This configuration could be used with the two long isothermal zones separated by a desired thermal gradient for experiments such as vapor transport.

Two cold ends could be joined together (each cold end contains a 800° C. max. heater and a liquid cooled heat sink) to accomplish lower temperature work but in the same configuration as with two hot zones. For experiments where only one hot zone is required the end caps could be placed directly on the end of the hot zone. This would provide a shorter isothermal heater.

In addition to the major segments being interchangeable each heater core (containing one or more heating elements) is easily removable. This provides the capability of installing different kinds of heated zones in each of the different assembly configurations. As an example, the hot isothermal heater could be replaced with customized heater winding to establish thermal requirements unique to an individual experiment, such as would be required for vapor or liquid transport experiments. Since the adiabatic (insulated zone) zone is removable, its thermal properties can be changed to achieve specific requirements or removed completely and replaced with additional booster heaters to further customize the thermal conditions in the growth region.

The directional solidification of the present invention can produce thermal processing conditions that could not be achieved in the past. It allows larger diameter samples to be processed under steeper thermal gradients than is presently possible. The use of a series of thermal control zones arranged to produce two isothermal zones and a very steep temperature gradient by the arrangement and dimensions of the booster heater, adiabatic zone, and the heat transfer plate produced results not heretofore provided.

While a preferred embodiment of the invention has been described using specific terms, such description is for illustrative purposes only, and it is to be understood that changes and variations may be made without departing from the spirit or scope of the following claims.

What is claimed is:

1. A directional solidification furnace comprising:

an elongated tube adapted to receive and have translated therethrough a material-containing ampule;

a plurality of annular elements disposed around said tube along its length and in heat transfer relation therewith, individual elements of said plurality having a heating, cooling or passive character;

said elements being selected and placed so as to provide within said tube a hot region adjacent one end, a heated, but cooler, region adjacent the other end and an intermediate region therebetween having a steep axial thermal gradient;

said elements including a passive element disposed around said intermediate region, a booster heater element between said passive element and said hot region and a cooling element between said passive element and said cooler region;

housing means and means for actuating said elements.

2. The apparatus of claim 1 wherein said cooling element includes a plate, a cooling jacket carried in heat transfer relation therewith and having an inlet and outlet for passing a heat transfer liquid through said jacket.

3. The apparatus of claim 2 wherein said elements include a hot end heater disposed along a major portion of said hot region and a separately controllable heater disposed adjacent the outer end of said hot region.

4. The apparatus of claim 3 wherein said elements include a passive insulating element disposed between said hot end heater and said booster heater element.

5. The apparatus of claim 4 wherein said elements include a cooler end heater disposed along a major portion of said cooler region and a separately controllable heating element disposed adjacent the outer end of said cooler region.

6. The apparatus of claim 5 including insulation means disposed between said housing and all of said elements except said cooling element and said cooler end heater.

7. The apparatus of claim 6 wherein said insulation means comprises a stacked array of alternating layers of refractory metal sheet and refractory fibrous material.

8. The apparatus of claim 7 wherein said refractory metal is molybdenum and said fibrous material is quartz wool.

9. A directional solidification furnace for impressing a steep thermal gradient across a sample material comprising:

an elongated tube adapted to receive and have translated therethrough a material-containing ampule;

temperature-influencing means disposed outside said tube and along its length and defining in said tube a hot end region adjacent one end, a heated, but cooler region adjacent the other end and an intermediate region having a steep thermal gradient;

said temperature-influencing means including a passive insulating element disposed around said intermediate region of said tube, a cooling element disposed between said passive insulating element and said cooler region, a booster heater element disposed between said passive insulating element and said hot region, and a plurality of heating elements disposed around said hot region and said cooler region;

insulation means enclosing selected ones of said heating elements so as to provide a flat temperature profile in said end regions; and an external housing enclosing and supporting the said elements and insulation.

10. The apparatus of claim 9 including a passive insulating element disposed between said booster heater and said hot region heating elements.

11. The apparatus of claim 10 wherein a separately controllable annular heating element is disposed side-by-side around each of said end regions.

12. The apparatus of claim 11 wherein said cooling element comprises a jacketed metal plate in heat transfer contact with said tube and adapted to have a liquid coolant passed therethrough.

13. The apparatus of claim 12 wherein said insulation means comprises a stacked array of molybdenum metal sheet and fibrous refractory material.

14. A directional solidification furnace adapted to provide along its length two relatively uniform elevated temperature regions with a region of steep thermal gradient therebetween comprising:

an elongated tube adapted to receive and have translated therethrough a material-containing ampule;

a plurality of annular elements disposed side-by-side along the length of and in heat-transfer relation with said tube, said elements comprising:

a first relatively narrow, high-power heating element disposed around the tube adjacent its hotter end and adapted to be operated in such a manner as to compensate for heat loss out the said tube end;

a first relatively wide heating element disposed adjacent said first high-power heating element over a major portion of the hotter end region of said tube;

a first passive insulating element disposed over said tube adjacent said first wide heating element;

a narrow, high-power booster heating element disposed over said tube adjacent to said first passive heating element;

a second passive insulating element disposed over said tube adjacent said booster and enclosing the circumference of said steep thermal gradient region;

a cooling element disposed over said tube and adjacent said second passive insulating element;

a second relatively wide heating element disposed over said tube adjacent to said cooling element; and a second relatively narrow, high-power heating element disposed over said tube adjacent to said second relatively wide heating element and adjacent to the cooler end of said tube;

insulation means disposed around all of said elements except said second relatively wide heating element; and said cooling element; and housing means.

15. The apparatus of claim 14 wherein said cooling element includes a metal plate and a cooling jacket having an inlet and outlet for passing a heat transfer liquid therethrough.

16. The apparatus of claim 14 wherein said elements disposed over said hotter end region and said thermal gradient region are carried by a cylindrical housing having a flange extending outward from said thermal gradient region.

17. The apparatus of claim 16 wherein said plate of said cooling element is secured to said flange.

18. The apparatus of claim 16 including cooling means in heat transfer relation with the exterior of said housing.

19. The apparatus of claim 18 wherein said insulation means comprises a stacked array of alternating layers of refractory metal sheet and fibrous refractory material.

20. The apparatus of claim 19 wherein said heating elements include a grooved ceramic core in which heating wire is embedded.

* * * * *